US005196658A

United States Patent [19]

Gula

[11] Patent Number: 5,196,658

[45] Date of Patent: Mar. 23, 1993

[54] INTEGRAL MANUAL ON/OFF CRANK ASSEMBLY

[75] Inventor: Lance Gula, Aliquippa, Pa.

[73] Assignee: Westinghouse Electric Corp., Pittsburgh, Pa.

[21] Appl. No.: 709,008

[22] Filed: May 31, 1991

[51] Int. Cl.[5] ..... H01H 9/22

[52] U.S. Cl. ..... 200/50 R; 200/330

[58] Field of Search ..... 200/17 R, 50 R, 50 AA, 200/50 A, 330; 361/334–345

[56] References Cited

U.S. PATENT DOCUMENTS

| | | | |
|---|---|---|---|
| 4,002,865 | 1/1977 | Kuhn et al. | 200/50 AA |
| 4,553,115 | 11/1985 | Grunert et al. | 335/14 |
| 4,642,726 | 2/1987 | Matsko et al. | 361/198 |
| 4,804,809 | 2/1989 | Thompson, Jr. et al. | 200/17 R |
| 4,951,020 | 8/1990 | Changle et al. | 335/167 |
| 4,990,873 | 2/1991 | Grunert et al. | 335/68 |

OTHER PUBLICATIONS

Underwriter's Laboratory Standard UL 489, pp. 74–75, Sep. 15, 1976.

*Primary Examiner*—J. R. Scott
*Attorney, Agent, or Firm*—M. J. Moran

[57] ABSTRACT

An electric operator having a reciprocally mounted actuator is adapted to be mechanically coupled to an operating handle from a molded case circuit breaker or a molded case switch for moving the operating handle between an open position or, alternatively, to a closed position. The electric operator includes an electric motor for driving the actuator and allowing the circuit breaker to be controlled from a remote location and a mechanical crank assembly which alternatively allows for manual operation of the actuator in the event of a loss of electric power to the electric motor.

30 Claims, 11 Drawing Sheets

FIG.1.
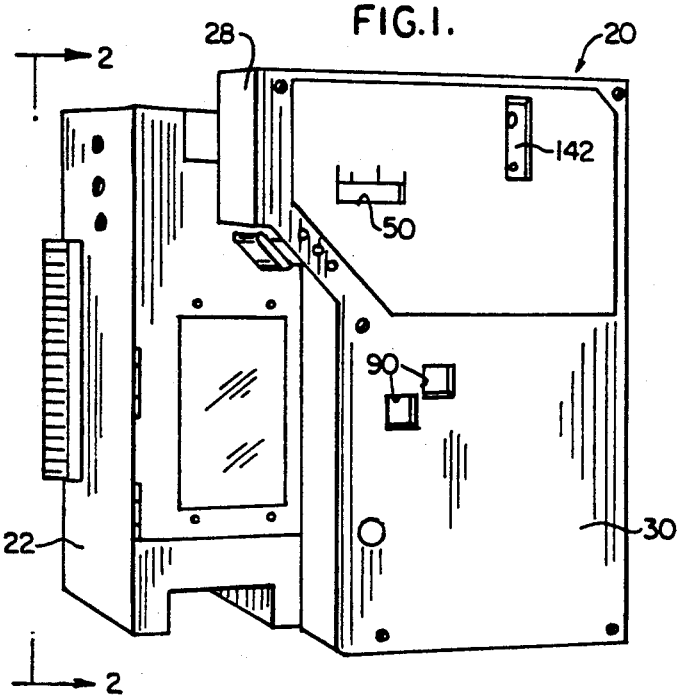
FIG.3.
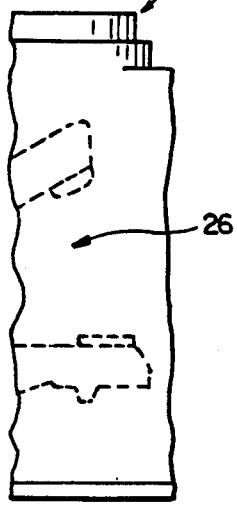
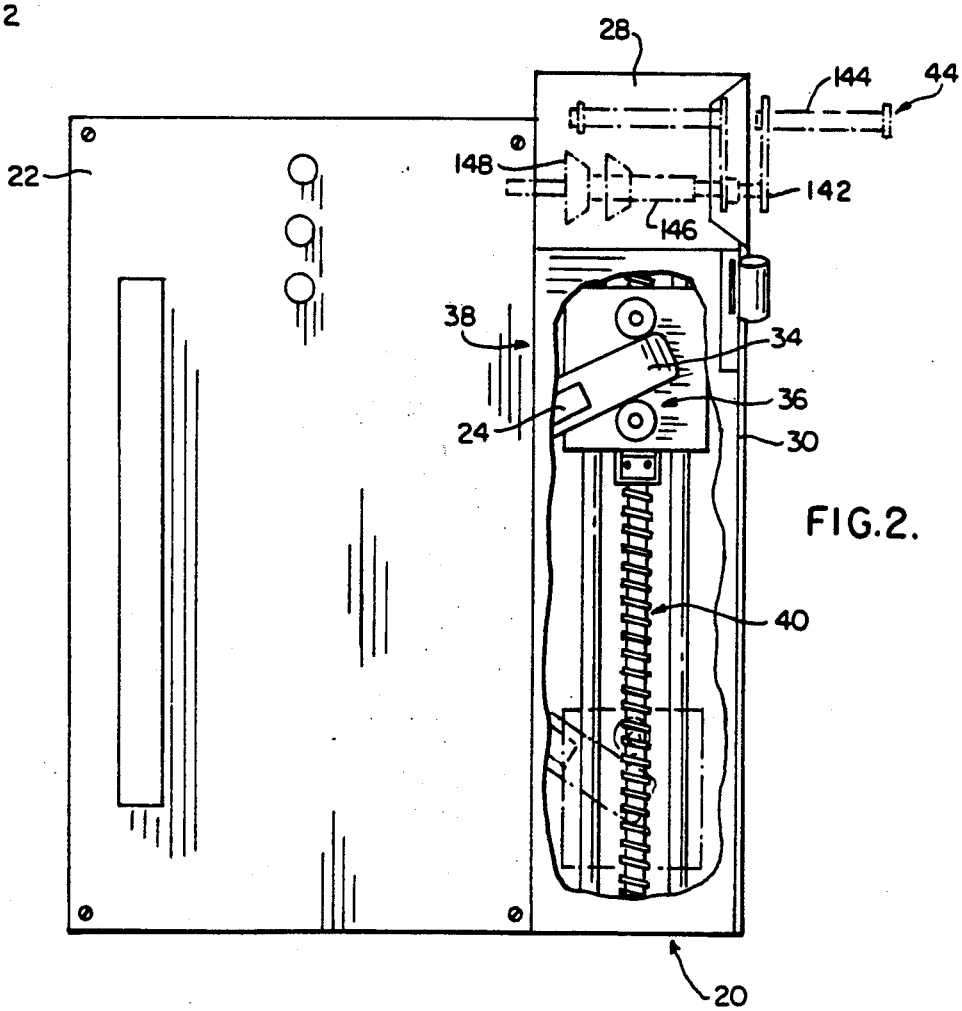
FIG.2.

38
40
60
64
66
68
70
72
74
76
80
82
84
92
94
96
110
112
113
115
116
117
118
120
122
124
126
128
130
131
132
133

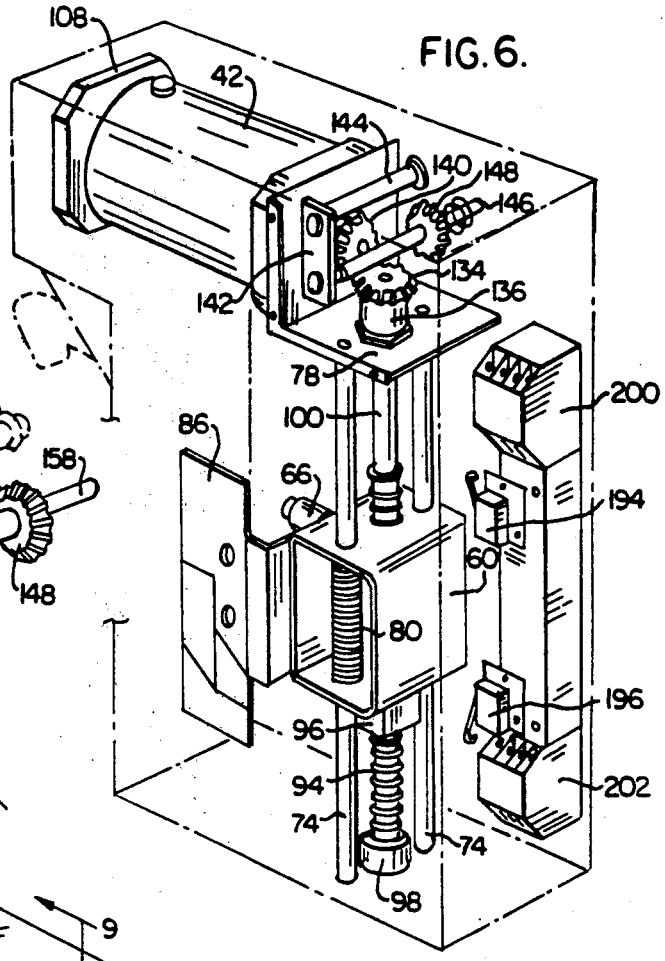
FIG. 6.
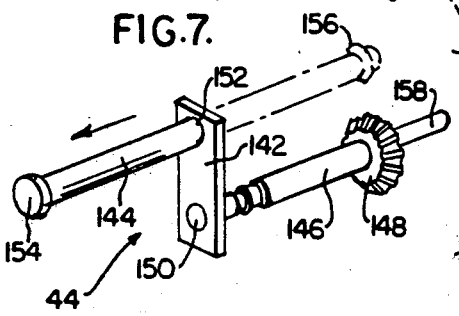
FIG. 7.
FIG. 8.
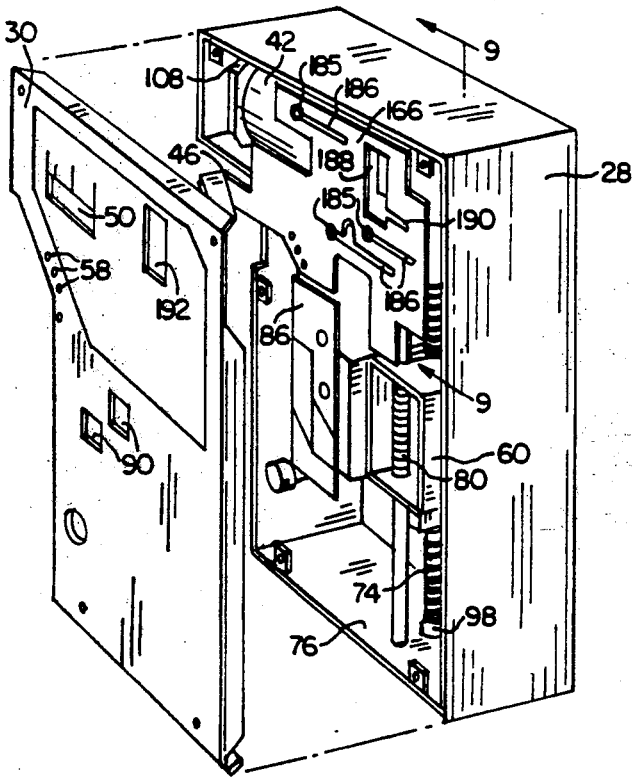
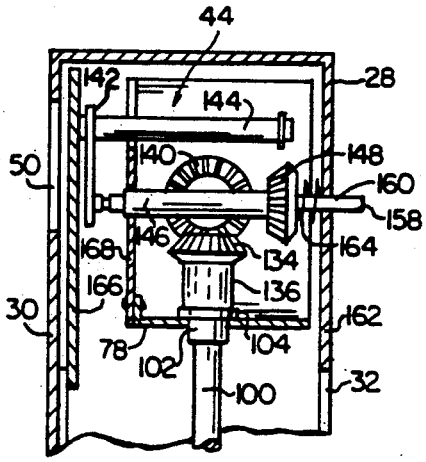
FIG. 9.

INTEGRAL MANUAL ON/OFF CRANK ASSEMBLY

CROSS REFERENCE TO RELATED APPLICATIONS

The invention disclosed herein relates to an electric operator for molded case circuit breakers: The following commonly assigned U.S. Pat. Nos. relate to molded case circuit breakers: 5,119,054; 5,057,806; 5,032,813; 5,027,096 and 4,973,927.

The following commonly assigned patent applications also relate to molded case circuit breakers:

U.S. Pat. application Ser. No. 07/414,627, filed on Sep. 26, 1989, entitled SCREW ADJUSTABLE CLINCH JOINT WITH BOSSES which is a continuation of U.s. Pat. application Ser. No. 07/256,818, filed on Oct. 12, 1988, and now abandoned.

U.S. Pat. application Ser. No. 07/256,878, entitled TWO-PIECE CRADLE LATCH FOR CIRCUIT BREAKER, filed on Oct. 12, 1988, and now abandoned.

Commonly owned patent application Ser. No. 07/503,812 was filed on Apr. 3, 1990, entitled CIRCUIT BREAKER POSITIVE OFF LINK, by David A. Parks, Thomas A. whitaker and Y. W. Chou.

Commonly owned Pat. application Ser. No. 07/543,985 was filed on Jun. 26, 1990, entitled PHASE SENSITIVITY, by Stephen Mrenna, L. M. Hapeman, John a. Wafer, Robert J. Tedesco, Kurt a. Grunert and Henry A. Wehrli III.

Lastly, commonly owned Pat. application Ser. No. 07/676,584 was filed on Mar. 28, 1991, entitled LINE COPPER GASKET, by Arthur Carothers.

BACKGROUND OF THE INVENTION

1. Field of the Invention

The present invention relates to an electric operator for a molded case circuit breaker, switches and the like and, more particularly, to an electric operator having a reciprocally mounted actuator, adapted to be mechanically coupled to a circuit breaker operating handle, for moving the operating handle between an open position or, alternatively, to a closed position, which includes an electric motor for driving the actuator and allowing the circuit breaker to be controlled from a remote location and a mechanical crank assembly which alternatively allows for manual operation of the actuator in the event of a loss of electric power to the electric motor.

2. Description of the Prior Art

Molded case circuit breakers are generally used to provide overcurrent protection for various types of electrical equipment. However, in some applications, it is necessary to control such circuit breakers from a remote location. Also molded case switches are known. In such applications, electric operators may be provided that are adapted to be mechanically coupled to the operating handle of the circuit breaker or molded case switch. Both solenoid operators and motor operators are known. Examples of solenoid operators for molded case circuit breakers and switches are disclosed in U.S. Pat. Nos. 4,553,115 and 4,642,726, assigned to the same assignee as the present invention. However, such solenoid operators are generally slow acting. Motor operators, on the other hand, are generally provided with high speed electric motors that are comparatively faster acting than a solenoid operator. An example of a motor operator is disclosed in U.S. Pat. No. 4,990,873, assigned to the same assignee as the present invention.

Both solenoid operators and motor operators are adapted to be rigidly mounted relative to the circuit breaker or molded case switch to be in communication with the operating handle. Such operators may either be disposed within the circuit breaker or switch housing or mounted either on the side or in the front of the circuit breaker. U.S. Pat. Nos. 4,553,115 and 4,642,726 breaker housing. U.S. Pat. No. 4,990,873 disclose motor operator mounted to one side of the circuit breaker housing.

Irrespective of the mounting arrangement of the electric operator relative to the circuit breaker or switch, the electric operator must include means for manual operation. This requirement for manual operation, promulgated in Underwriter's Laboratories Standard No. UL 489, is to allow for manual operation of the circuit breaker in the event of loss of electric power to the electric operator.

SUMMARY OF THE INVENTION

It is an object of the present invention to provide an electric operator for molded case circuit breakers and switches.

It is a further object of the present invention to provide an electric operator which includes an electric motor adapted to be mechanically coupled to an operating handle of a molded case circuit breaker or switch for driving the operating handle to an open position or, alternatively, to a closed position.

It is yet a further object of the present invention to provide an electric operator for a molded case circuit breaker or switch which includes provisions for manual operation in the event of a loss of electric power to the electric operator.

Briefly, the present invention relates to an electric operator for a molded case circuit breaker or switch which includes an electric motor, mechanically coupled to a ball screw assembly by way of a drive gear assembly. The ball screw assembly includes an actuator, formed thereon from a pair of spaced apart rollers for capturing an operating handle of the circuit breaker or switch to allow the operating handle to be driven to an open position or, alternatively, to a closed position. In order to allow operation of the circuit breaker or switch in the event of a loss of electric power to the electric operator, a manual crank assembly is provided which includes a crankshaft, movably mounted in an axial direction having a crank arm disposed intermediate one end and a drive gear disposed intermediate the opposite end. In a first position, the crankshaft is disposed such that the drive gear is not in engagement with the drive gear assembly. In this position, the ball screw assembly and the actuator are only responsive to the electric motor. In an alternate position, the drive gear disposed at the end of the crankshaft engages the drive gear assembly to allow for manual operation of the circuit breaker. The crankshaft is interlocked with a shutter, slidably mounted in a plane generally perpendicular to the axis of the crankshaft. The shutter includes a mode selector, extending exterior to the housing of the electric operator, to allow for manual selection of the operating mode. In one operating mode, the handle crank is positioned beneath the shutter causing the drive gear at the end of the crankshaft to be out of engagement with the drive gear assembly. In an alternate operating mode, an aperture, formed in the shutter, is aligned with the handle crank. In this mode, a biasing spring causes axial movement of the crankshaft forcing the drive gear at the end of the crankshaft into engagement with the drive gear assembly and the handle crank to pop through the aperture in the shutter and an aligned aperture in the cover to allow for manual operation of the assembly. The shutter is also interlocked with a limit switch in order to disconnect the source of electric power from the electric motor during manual operation.

DESCRIPTION OF THE DRAWING

These and other objects and advantages of the present invention will become readily apparent upon consideration of the following detailed description and attached drawing, wherein:

FIG. 1 is a perspective view of an electric operator in accordance with the present invention rigidly mounted to a molded case circuit breaker;

FIG. 2 is an elevational view along line 2—2 of FIG. 1 with a portion of the cover broken away, illustrating the electric operator, the circuit breaker operating handle and the handle crank assembly in alternate positions;

FIG. 3 is a partial sectional view of a molded case circuit breaker or switch illustrating the main contacts.

FIG. 6 is a perspective view of the interior components within the electric operator in accordance with the present invention with the housing shown in phantom;

FIG. 7 is a perspective view of the handle crank assembly in accordance with the present. invention, illustrating the crank handle in alternate positions;

FIG. 8 is a perspective view of the electric operator in accordance with the present invention with the cover removed;

FIG. 9 is a partial sectional view along line 9 of FIG. 8;

DETAILED DESCRIPTION OF THE DRAWING

Figures 4, 5:
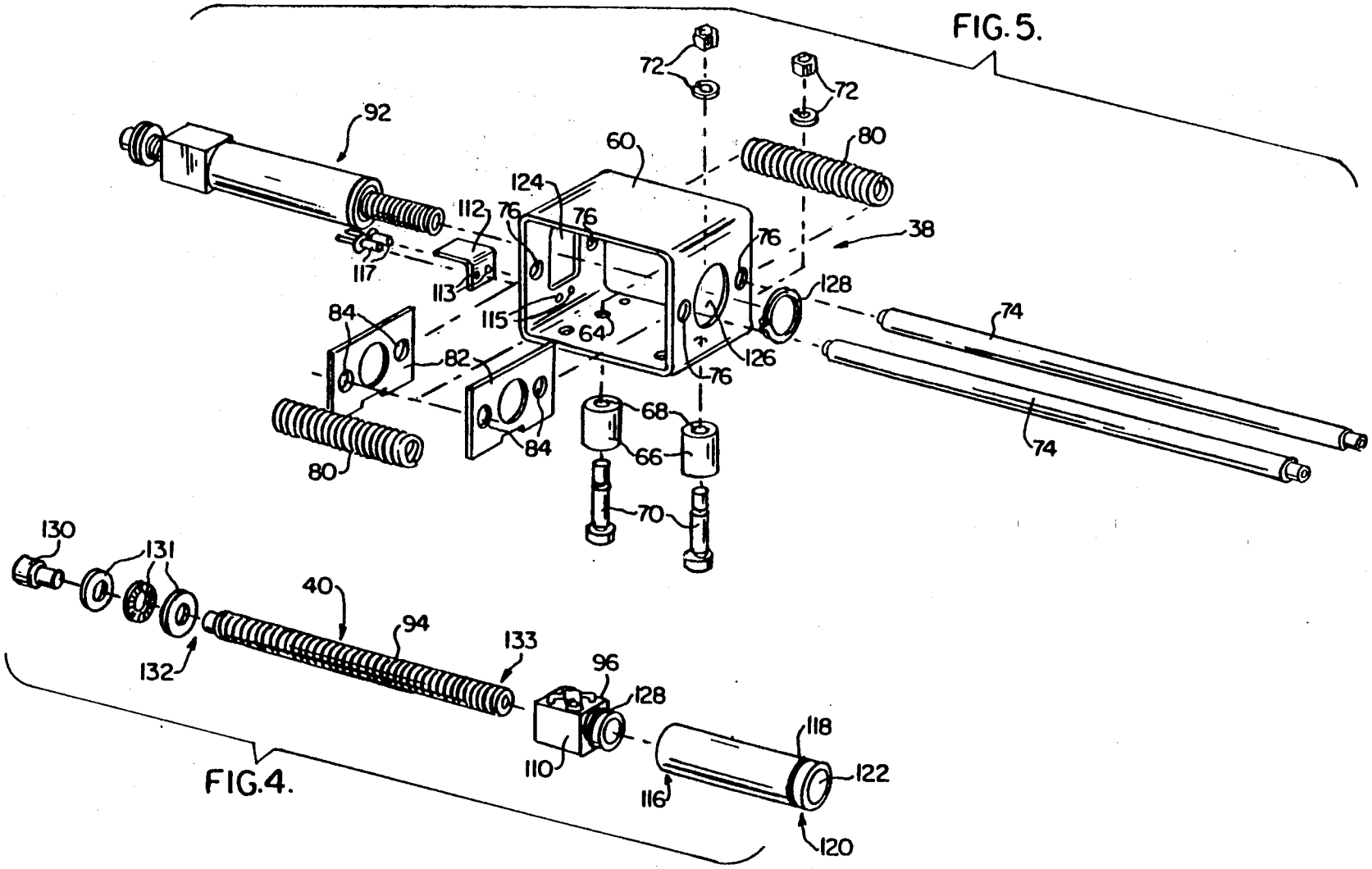
FIG. 4 is an exploded perspective view of a ball screw assembly in accordance with the present invention.
FIG. 5 is an exploded perspective view of a handle actuator assembly and the ball screw assembly in accordance with the present invention.

The electric operator in accordance with the present invention is generally identified with the reference numeral 20. The electric operator 20 is adapted to be disposed adjacent a molded case circuit breaker 22 or a molded case switch having an outwardly extending operating handle 24 (FIG. 2) as shown in FIG. 1 Such an arrangement encloses the extending operating handle 24 to provide a flush exterior surface and eliminates inadvertent contact with the operating handle 24. A typical molded case circuit breaker suitable for use with the electric operator 20 is disclosed in U.S. Pat. No. 4,951,020, assigned to the same assignee as the assignee of the present invention, hereby incorporated by reference. Such circuit breakers 22 and switches include a pair of separable main contacts 26 (FIG. 3), controlled by the operating handle 24.

Figure 11:
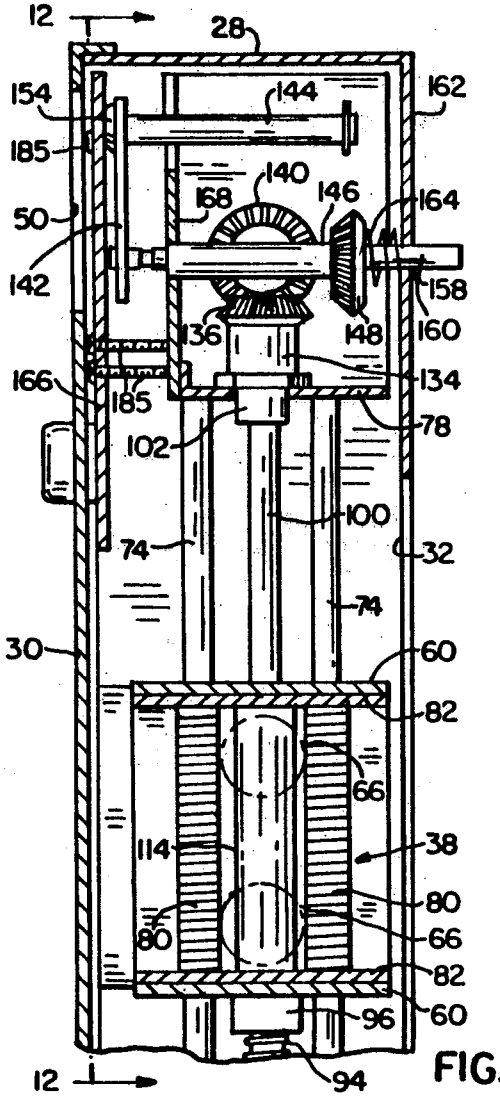
FIG. 11 is a partial sectional view along line 11—11 of FIG. 10.
Figure 14:
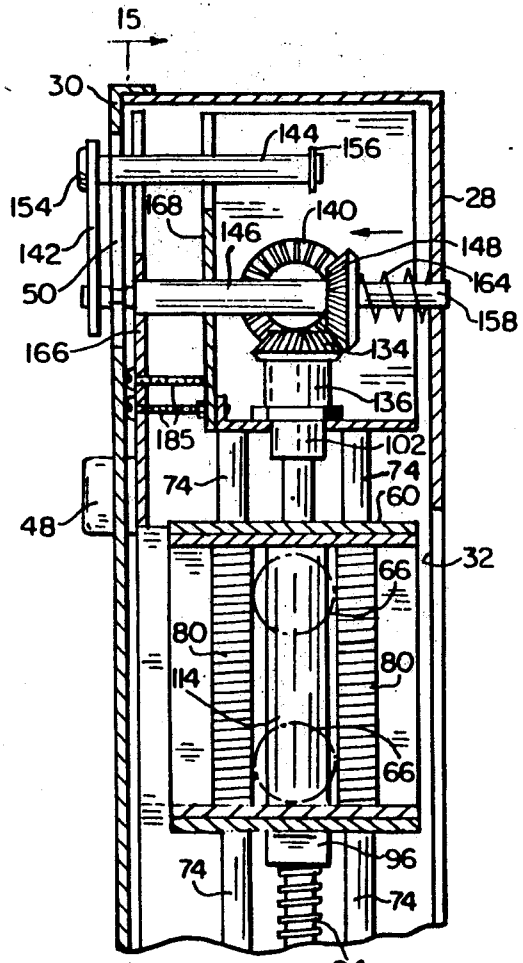
FIG. 14 is a partial sectional view along line 14—14 of FIG. 13.

The electric operator 20 is disposed in a housing 28 having a removable cover 30 (FIG. 8). The housing 28 is provided with a rear access opening 32 (FIGS. 11 and 14) for receiving the operating handle 24. The electric operator 20 is mounted adjacent the molded case circuit breaker 22 or switch such that the operating handle 24 is aligned with the rear access opening 32 in the housing 28. A handle extension 34 (FIG. 2) may be used to extend the length of the operating handle 24, forming an operating handle assembly 36. The operating handle assembly 36 may then be mechanically coupled to a handle actuator assembly 38 and a drive assembly 40 to enable the operating handle assembly 36 to be driven to an open position or, alternatively, to a closed position.

Under normal conditions (e.g., when electric power is available to the electric operator 20), the drive assembly 40 is driven by an electric motor 42 (FIG. 6). As will be discussed below, the electric motor 42 is a reversible motor in order to allow the operating handle assembly 36 to be driven between an open position and a closed position. In the event that electric power is unavailable to the electric operator 20, a manual crank assembly 44 (FIG. 7) is provided. As will be discussed below, the manual crank assembly 44 is mechanically interlocked with the drive assembly 40 to allow for selective engagement of the manual crank assembly 44 with the drive assembly 40.

OPERATING MODES

Figure 12:
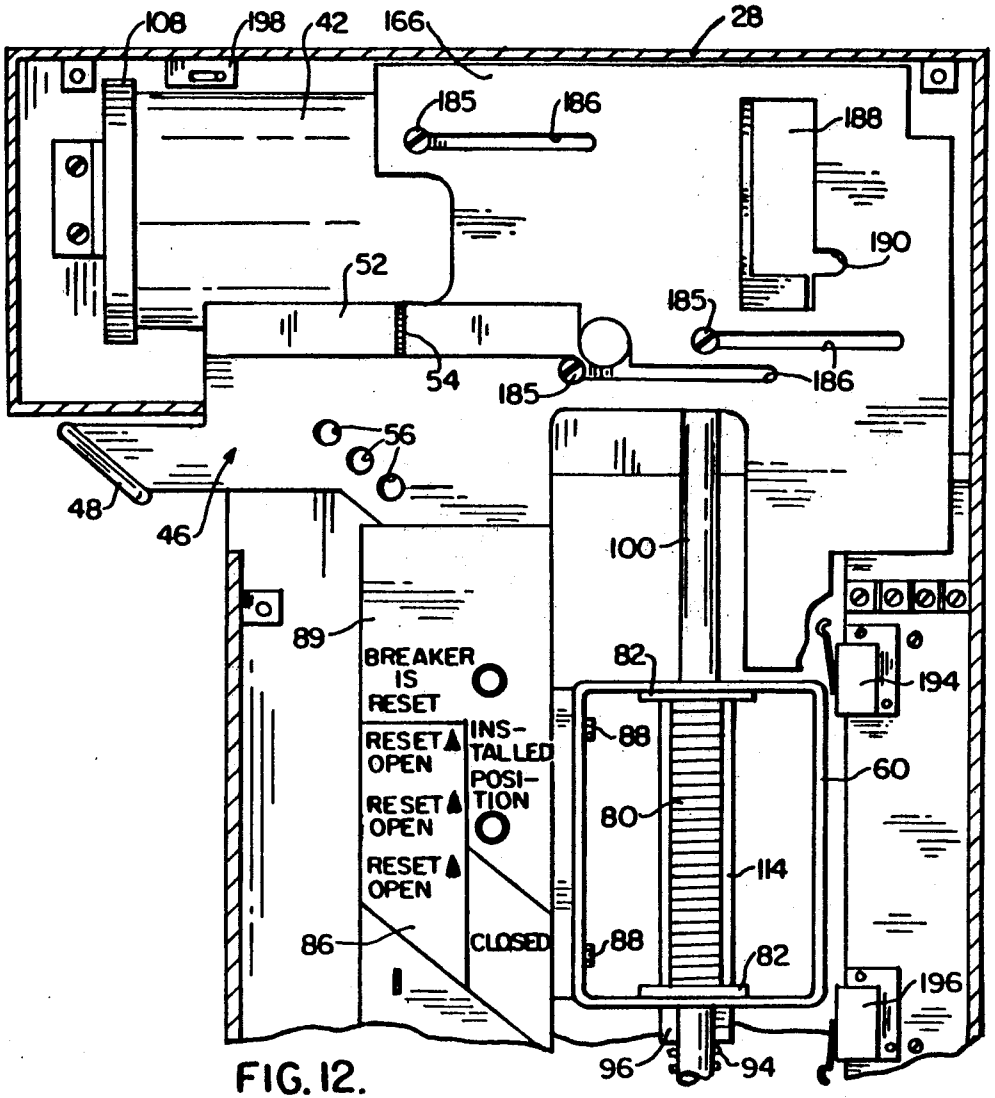
FIG. 12 ia an elevational view along line 12—12 1.

The operating mode of the electric operator is controlled by a mode selector 46 (FIG. 12) which includes a control lever 48 which extends outwardly from the operator housing 28. The control lever 48 allows an operator to select between the various modes of operation. The selected operating mode is indicated on the removable cover 30 as illustrated in FIGS. 10, 13, 18 and 19. More specifically, an aperture 50 (FIG. 8) is provided in the cover 30. This aperture 50 is aligned with a mode indicator 52 (FIG. 12), rigidly attached to the mode selector 46. The mode indicator 52 may be formed, for example, from an adhesive strip, which may be affixed to the mode selector 46 as best shown in FIG. 12. The mode indicator 52 is encoded, for example, with a vertical line segment 54 to indicate the position of the mode selector 46. The various operating modes of the electric operator 20 may then be identified on the cover 30 adjacent the aperture 50 to indicate the particular operating mode of the electric operator 20.

Figure 10:
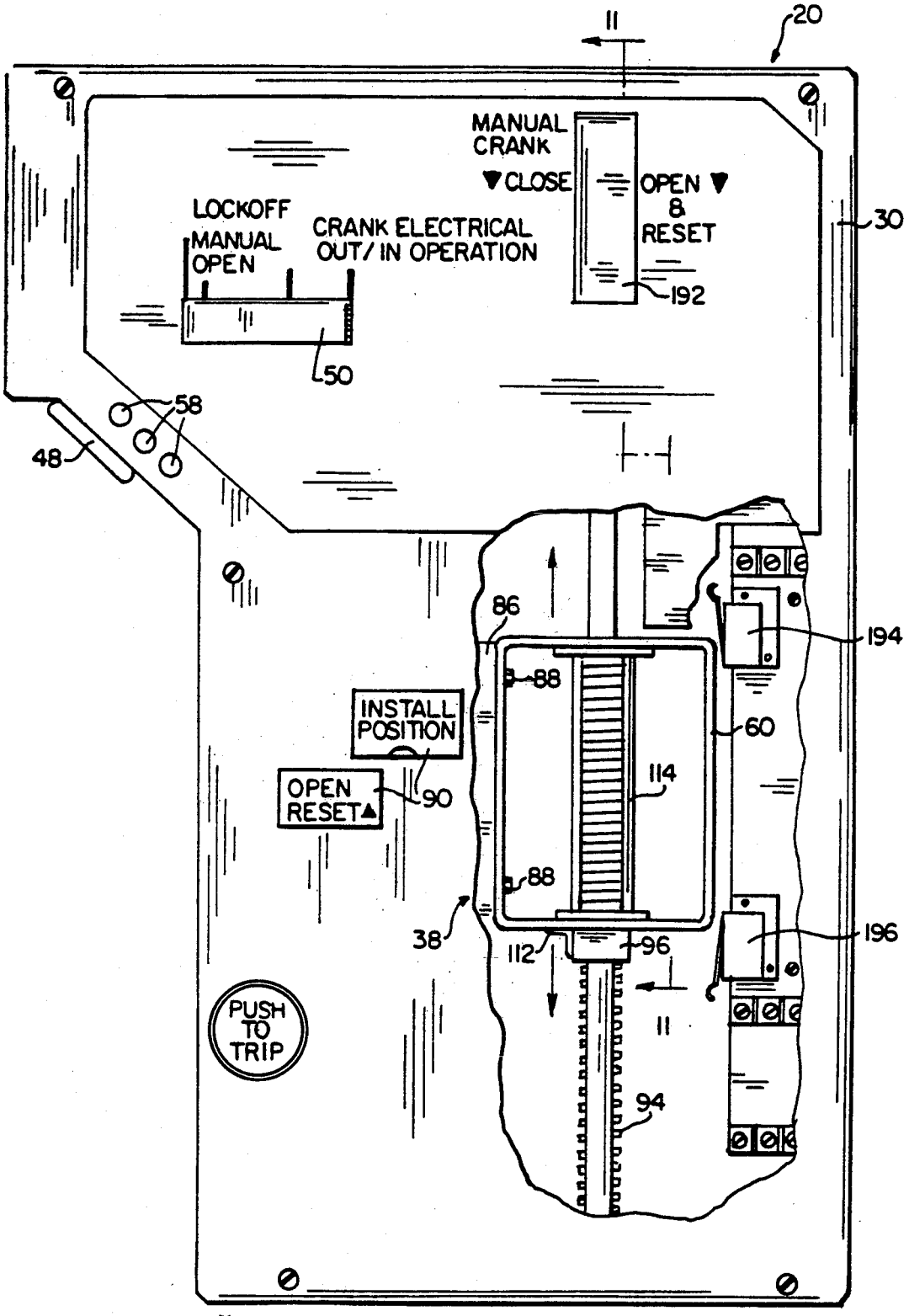
FIG. 10 is an elevational view of the element operator in accordance with the present invention with a portion of the cover broken away illustrating the mode selector in "an "Electrical Operation" position.
Figure 13:
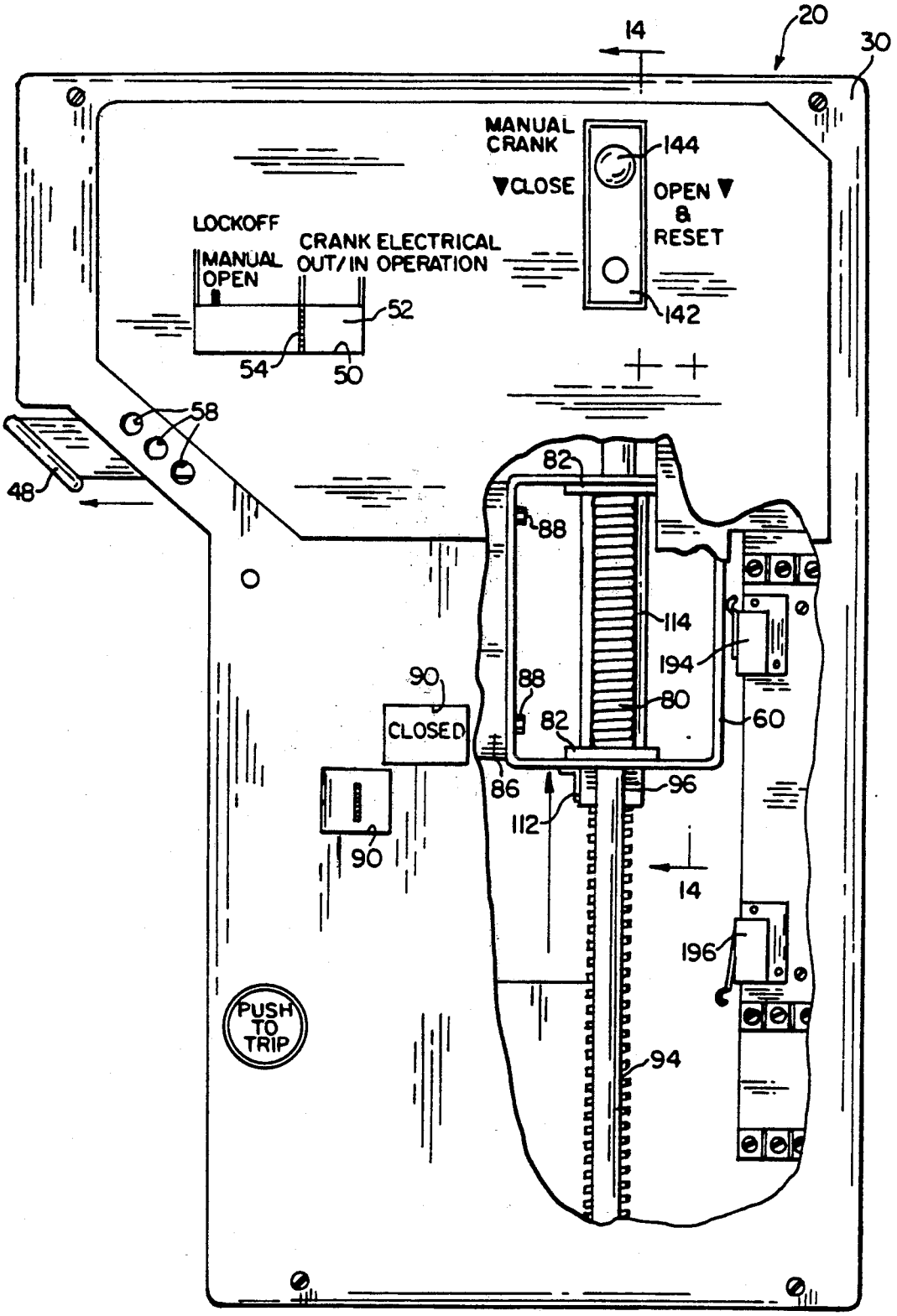
FIG. 13 is similar to FIG. 10 illustrating the mode selector in a "Crank In/Out" position.
Figure 15:
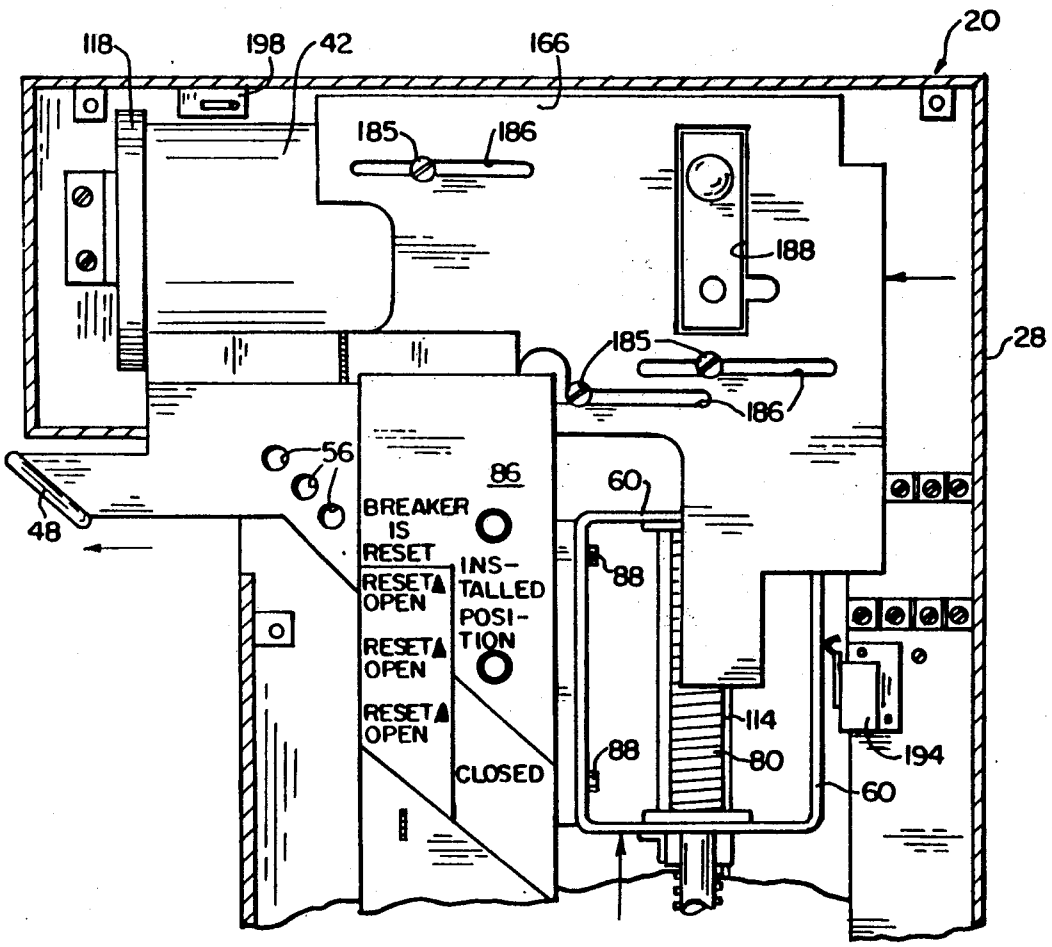
FIG. 15 is a partial elevational view along line 15—15 of FIG. 14 with the cover removed illustrating the slide plate in the Crank In/Out position.
Figure 19:
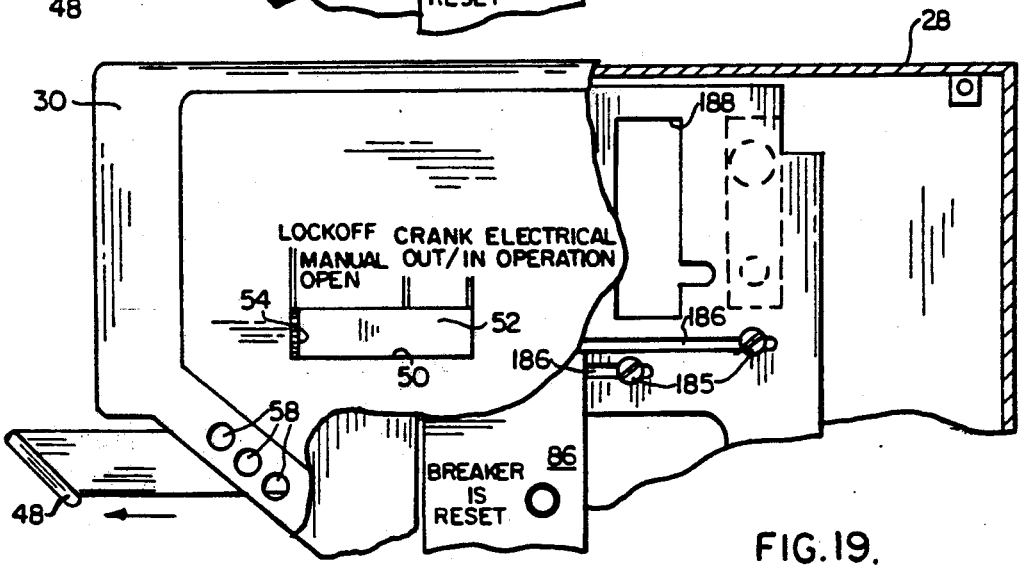
FIG. 19 is similar to FIG. 18 illustrating the slide plate in a "Lock Off" position.
Figure 20:
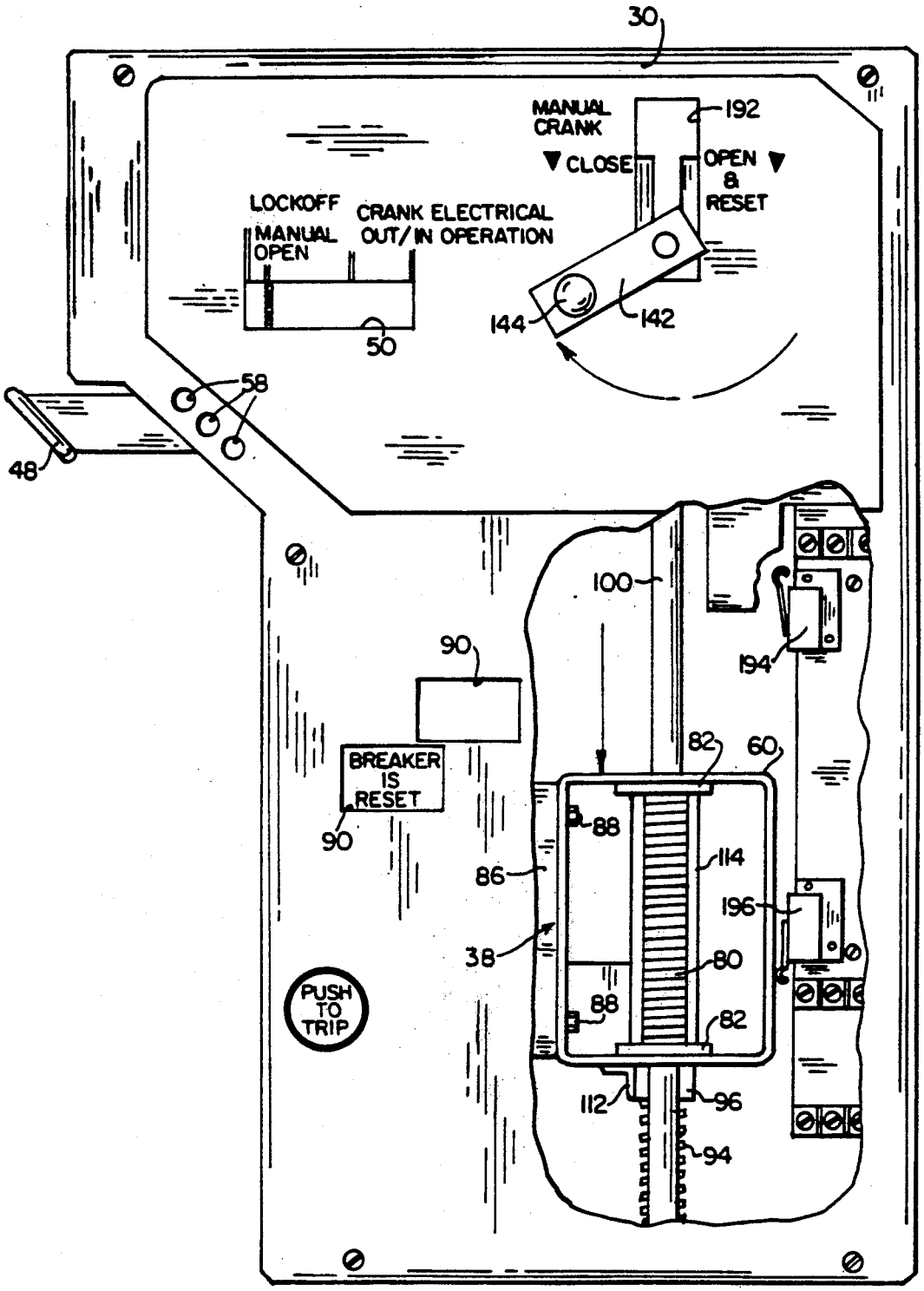
FIG. 20 is similar to FIG. 10 illustrating operation of the handle crank.

The electric operator 20 in accordance with the present invention has four operating modes: Electric Operation; Crank Out/In; Manual Open And Lock Off. As illustrated in FIGS. 10, 13, 18 and 19, the mode indicator 52 indicates the position of the electric operator 20 in its various operating modes. More specifically, FIG. 10 illustrates the electric operator 20 in an Electric Operation mode. In this mode of operation, the drive assembly 40 is under the control of the electric motor 42. FIG. 13 illustrates the electric operator 20 in the Crank Out/Crank In mode. As will be discussed in more detai) below, in this mode the manual crank assembly 44 is made accessible to an operator and placed into engagement with the drive assembly 40. However, the manual crank assembly 44 is not operated in this mode. FIG. 20 illustrates the electric operator 20 in the Manual Open mode. In this mode of operation, the manual crank assembly 44 is used to drive the drive assembly 40. As will be discussed below in more detail, the electric power to the electric motor 42 is disconnected in this mode. FIG. 19 illustrates the electric operator 20 in the Lock Off mode. In this mode of operation, both the electric motor 42 and the manual crank assembly 44 are disabled. Apertures 56 (FIG. 12) are provided on the mode selector 46 which are adapted to be aligned with apertures 58 (FIG. 13) on the cover 30 to allow the electric operator 20 to be disabled and padlocked for maintenance purposes in the Lock Off mode.

HANDLE ACTUATOR ASSEMBLY

The handle actuator assembly 38 includes a generally box-like frame 60 (FIG. 5) open on two sides. A pair of spaced apart apertures 64 are provided on one side of the frame 60 for mounting a pair of rollers 66. The rollers 66 are mounted for rotatable movement relative to the frame 60. More specifically, the rollers 66 are provided with centrally disposed apertures 68 which, in turn, are aligned with the apertures 64 in the frame 60. Shoulder bolts 70, received in the aligned apertures 64 and 68, are secured to the frame 60 with suitable fasteners 72. As shown best in FIG. 2, the operating handle assembly 36 is received between the rollers 66.

The handle actuator assembly 38 is mounted for linear reciprocal movement relative to the housing 28. More specifically, the handle actuator assembly 38 is movably mounted relative to a pair of spaced apart guide rods 74, received in aligned apertures 76 on opposing sides of the frame 60. The guides 74 are rigidly mounted on one end to a bottom surface 76 (FIG. 8) of the housing 28 and to a bracket 78 (FIG. 6), rigidly secured to the housing 28 on the other end.

In order to dampen oscillations of the handle actuator assembly 38 at the ends of travel, springs 80 (FIG. 5) are provided. The springs 80 are disposed within the frame 60, intermediate a pair of spring plates 82, disposed interior to the frame 60 on opposite ends. Apertures 84 are provided in the spring plates 82 and aligned with the apertures 76 in the frame 60 and central core of the springs 80. The guides 74 are received in the aligned apertures 76 and 84 and the central core of the springs 80 to form the handle actuator assembly 38 which is driven by the drive assembly 40 in either an electric mode of operation or a manual mode of operation.

In order to provide indication of the status of the electric operator 20 and the circuit breaker 22 or switch, an indicator 86 (FIGS. 6 and 12) may be provided. The indicator 86 may be formed as a generally L-shaped bracket, rigidly secured to one side of the frame 60 with suitable fasteners 88 (FIG. 10). Adhesive tape 89 (FIG. 12) may be applied to the bracket 86 and encoded to indicate a circuit breaker (e.g., "OPEN", "CLOSED", "RESET" and "INSTALL" position). Apertures 90 (FIGS. 1, 8 and 11) in the cover 30 are provided and aligned such that the status of operator 20 is viewable from the outside of the electric operator 20.

DRIVE ASSEMBLY

The drive assembly 40 (FIG. 4) is mechanically coupled to the handle actuator assembly 38 to drive the handle actuator assembly 38 between an OPEN position and alternatively to a CLOSED position in both a manual mode of operation and an electric mode of operation. The drive assembly 40 includes a ball screw assembly 92 (FIGS. 4, 5) which includes a ball screw 94 and a ball nut 96. One end of the ball screw 94 is received in a bearing 98 (FIG. 6), rigidly mounted to the inside surface 76 of the housing 28. The other end of the ball screw 94 is rigidly attached to a ball screw extension 100 (FIGS. 6 and 11), formed as a shaft. The ball screw extension 100 is received in a bearing 102, secured in an opening 104 (FIG. 9) provided in the bracket 78.

The bracket 78 is rigidly secured to the housing 28 and acts as a motor mount for one end of the electric motor 42. The other end of the electric motor 42 is rigidly secured to another bracket 108, also rigidly secured to the housing 28.

The ball nut 96 is formed with a generally square cross-section having at least one flat 110. An L-shaped bracket 112 having spaced apart apertures 113 may be rigidly attached to the frame 60 of the handle actuator assembly 38 to restrain rotation of the ball nut 96. More specifically, the apertures 113 are aligned with spaced apart apertures 115 in the frame 60. Fasteners 117 are received in the apertures 113 and 115 to secure the bracket 112 to the frame 60. By restraining rotation of the ball nut 96, rotation of the ball screw 94 causes displacement of the ball nut 96 in either an upward or downward direction depending upon the direction of rotation of the ball screw 94.

In order to drive the handle actuator assembly 38, the ball screw assembly 92 is coupled thereto. More specifically, a sleeve or loader 114 is disposed within the frame 60 of the handle actuator assembly 38. The sleeve 114 is threaded on one end 116 and is provided with an annular groove 118 on the opposite end 120. The sleeve 114 is received within a square aperture 124 and a round aperture 126 in the frame 60 such that its annular groove 118 extends outwardly from the frame 60 on one end. A snap ring 128 is received in the annular groove 118 to secure one end of the sleeve 114 to the frame 60. The ball screw 94 is inserted through the aperture 124, the sleeve 114 and out the aperture 126. The ball nut 96 is received in the square aperture 124. An extending threaded portion 128 of the ball nut 96 is then fastened to a threaded end 116 of the sleeve 114, thereby securing the drive assembly 40 to the handle actuator assembly 38.

A cap screw 130 and appropriate fasteners 131 (FIG. 4) may be secured to one end 132 of the ball screw 94. The cap screw 130 is received in the bearing 98 (FIG. 6) to rotatably secure one end 132 of the ball screw assembly 92 to the housing 28. As previously mentioned, the other end 133 of the ball screw assembly 92 is secured to a ball screw extension 100 which, in turn, is rotatably secured to the bracket 78 by way of the bearing 102.

A drive gear 134, such as a bevel gear, is rigidly attached to the ball screw extension 100 by way of a suitable coupling 136. Thus, rotation of the drive gear 134 will cause rotation of the ball screw 94, which, in turn, will cause upward or downward movement of the handle actuator assembly 38 depending on the direction of rotation. As will be discussed below, the drive gear 134 may be driven by the electric motor 42 or alternatively by the manual crank assembly 44.

The electric motor 42 is disposed within the housing 28 such that its shaft (not shown) is generally perpendicular to the axis of the ball screw 94. A motor drive gear 140, formed as a bevel gear, is rigidly secured to the drive shaft and disposed in engagement with the drive gear 134. When the electric operator is in the "Electrical Operation" mode of operation, rotation of the motor drive shaft will cause upward and downward movement of the handle actuator assembly 38.

As will be discussed below, the electric motor 42 is provided as a reversible motor which is enabled by the mode selector 46. Electrical interlocking, also discussed below, disables the source of electrical power to the electrical motor 42 during other modes of operation.

HANDLE CRANK ASSEMBLY

An important aspect of the invention relates to the handle crank assembly 44. As best shown in FIG. 7, the manual crank assembly 44 includes a crank arm 142, a crank handle 144, a crankshaft 146 and a manual drive gear 48. The crank arm 142 is provided as a generally rectangular plate which includes a pair of spaced apart apertures 150 and 152 (FIG. 7). One end of the crankshaft 46 is rigidly affixed relative to the aperture 150. The other aperture 152 is adapted to slidably receive the crank handle 144. More specifically, the crank handle 144 is formed as a generally tubular member having a diameter slightly smaller than the diameter of the aperture 152. One end of the crank handle 144 is formed with a head 154 while the other end is provided with an annular ridge (not shown) for receiving a retaining ring 156. This arrangement allows the crank handle 154 to be placed in either a cranking position, shown in solid line in FIG. 7 or in a retract position as shown in phantom in FIG. 7.

The manual drive gear 148 is formed as a beveled gear, rigidly mounted to the crankshaft 146. The assembly of the crank arm 142, crankshaft 146 and the manual drive gear 148 is mounted for movement relative to the crankshaft axis to enable the manual crank assembly 44 to be placed in either a cranking position wherein the manual drive gear 148 is in engagement with the drive gear 134 disposed at the end of the ball screw extension 100 or in a retract position. As will be discussed below, the manual drive gear 148 will be in engagement with the drive gear 134 when the mode selector 46 is either in a Crank Out/In position or in a Manual Operation position.

Figure 16:
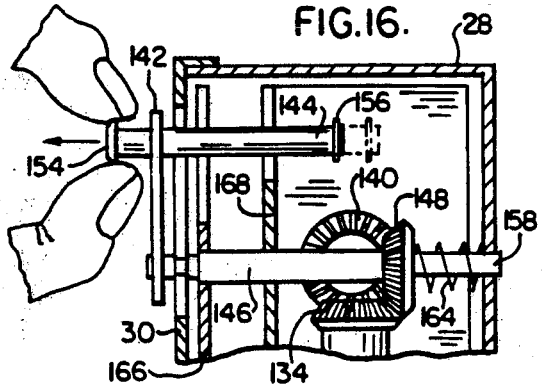
FIG. 16 is a partial sectional view of the electrical operator in accordance with the present invention illustrating the operation of the handle crank.
Figure 17:
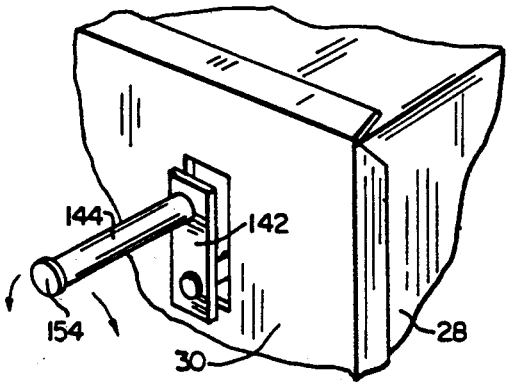
FIG. 17 is a partial perspective view of the electric operator in accordance with the present invention illustrating the handle crank in an operate position.
Figure 18:
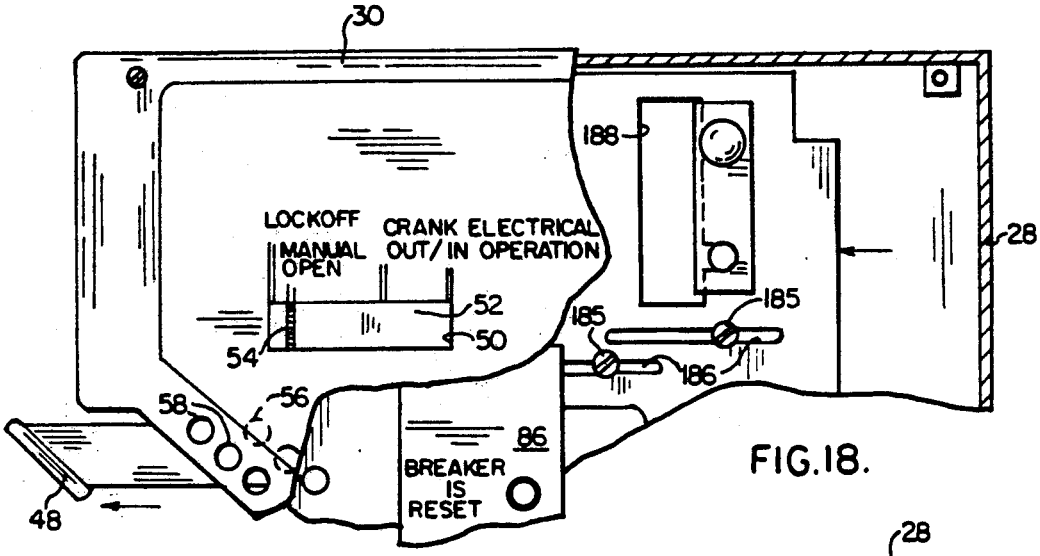
FIG. 18 is a partial elevational view with a portion of the cover broken away illustrating the slide plate in a "Manual Open" position.

The manual drive gear 144 is rigidly coupled intermediate one end of the crankshaft 146 defining an extending portion 158 (FIG. 9). The extending portion 158 is received in an aperture 160 (FIG. 11) in a rear surface 162 of the housing 28. A biasing spring 164 is disposed about the extending portion 158 between the manual drive gear 148 and the rear surface 162. The biasing spring 164 biases the manual crank assembly 44 into a cranking position as shown in FIGS. 16 and 17 when the mode selector 46 is in a Crank Out/In mode of operation under the control of a shutter 166.

Figure 21:
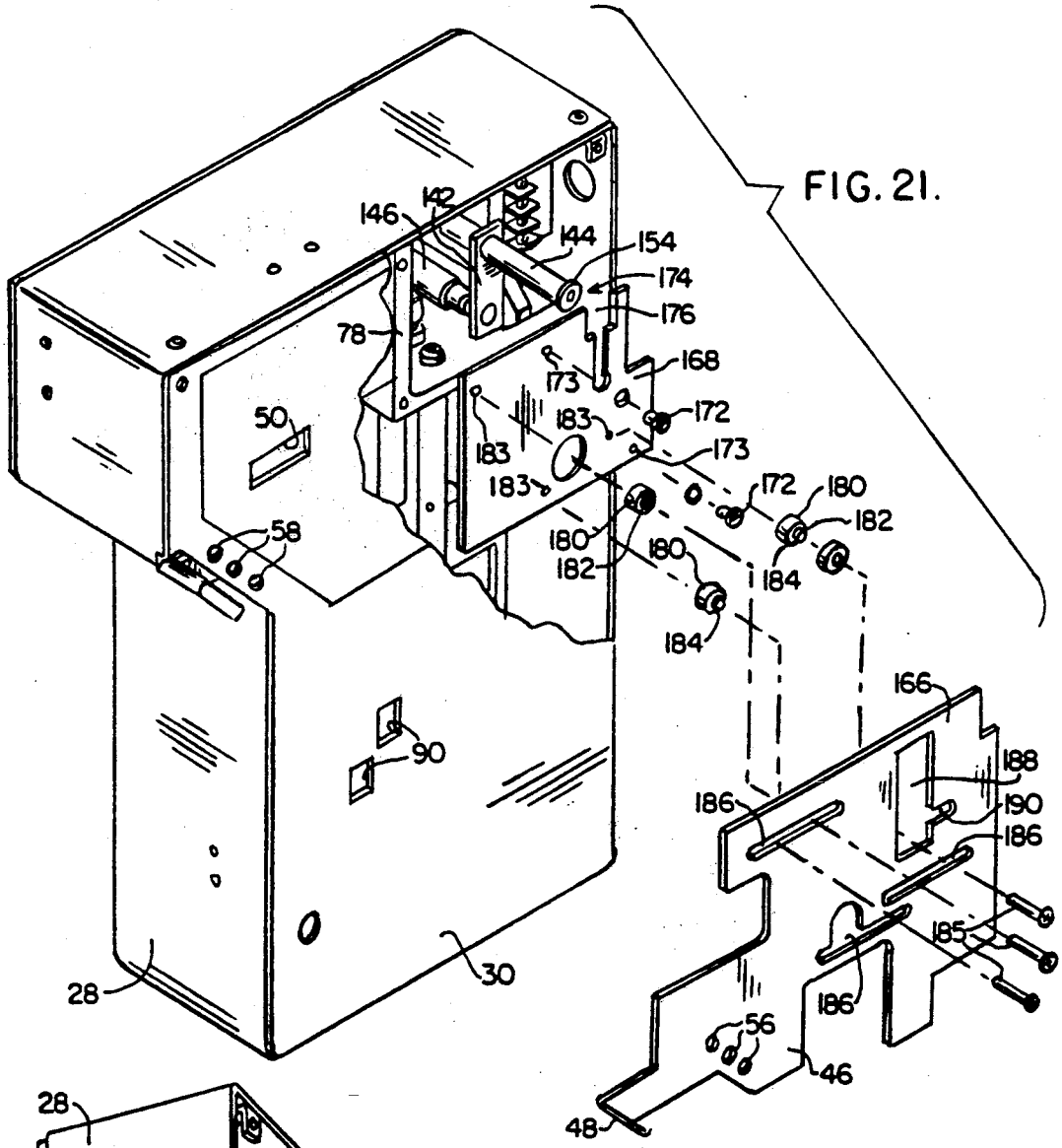
FIG. 21 is a partial exploded perspective view of the electric operator in accordance with the present invention with a portion of the cover removed.

The shutter 166, formed integral to the mode selector 46, controls the axial position of the manual crank assembly 44. More specifically, the shutter 166 is slidably mounted relative to a bracket 168 (FIG. 21) as will be discussed below. The bracket 168 is, in turn, rigidly attached to the bracket 78. The bracket 168 is generally rectangular-shaped and is secured to apertures 173 in the bracket 78 with a plurality of fasteners 172. The bracket 168 includes an irregular-shaped slot 174 which includes a crank handle receiving portion 176 and a journal portion 178. The crank handle receiving portion 176 allows the crank handle 144 to be placed in a retracted position and disposed within the housing 28. The journal portion 178 provides support for an extending end of the crankshaft 146.

Figure 22:
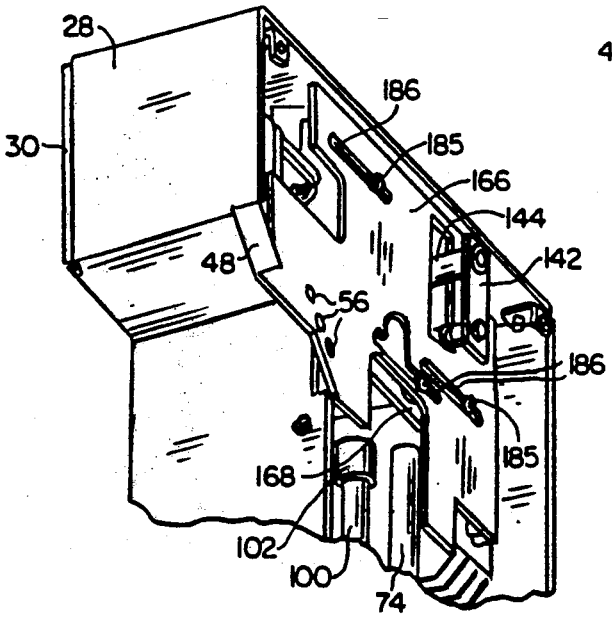
FIG. 22 is a partial perspective view of the electric operator in accordance with the present invention.

Spacers 180 having an upwardly extending sleeve portion 182 and threaded apertures 184 are aligned with the apertures 183 in the bracket 168. The sleeves 182 on the spacers 180 are adapted to be received in generally elongated slots 186 formed in the shutter 166 to allow the shutter 166 to be movably mounted relative to the bracket 168 as shown in FIG. 22 with a plurality of fasteners 185.

The shutter 166 also includes a generally rectangular aperture 188 having a U-shaped slot 190 disposed at one end. The aperture 188 is adapted to be aligned with the manual crank arm 142 and a rectangular aperture 192 (FIG. 8), formed in the cover 30 under the influence of the biasing spring 164 to allow the crank arm 142 to pop up through the cover 30 when the mode selector 46 is in a Crank In/Crank Out position. The mode selector 46 is then moved to the Manual Operation position which, in turn, allows a portion of the crankshaft 146 to be received in the U-shaped slot 190, which acts as a journal. As shown in FIGS. 16, 17 and 20, an operator then may pull the manual crank arm 142 to a cranking position as shown in FIG. 16 to drive the operating handle assembly 36 to either a closed position or, alternatively, to an open position in the event of a loss of electric power to the electric motor 42.

ELECTRIC CONTROL

Limit switches 194 and 196 (FIG. 10) are provided for control of the electric motor 42. These limit switches 194 and 196 are actuated by the frame 60 and are rigidly secured relative to the housing 30. Another limit switch 198 (FIG. 12) is disposed adjacent the shutter 166 in order to disable the electric motor 42 in all modes of operation except the Electrical Operation mode.

The limit switch contact 194 is closed in all positions except when the electric operator 20 is in the fully closed position. Similarly, the limit switch contact 196 is closed in all positions except when the electric operator 20 is in the fully open position.

The limit switch 198 is used to disable the electric operator 20 when it is not in an Electrical Operation mode of operation. Thus, the limit switch contact 198 is only closed when the electrical operator 20 is in an Electrical Operation mode of operation.

Figure 23:
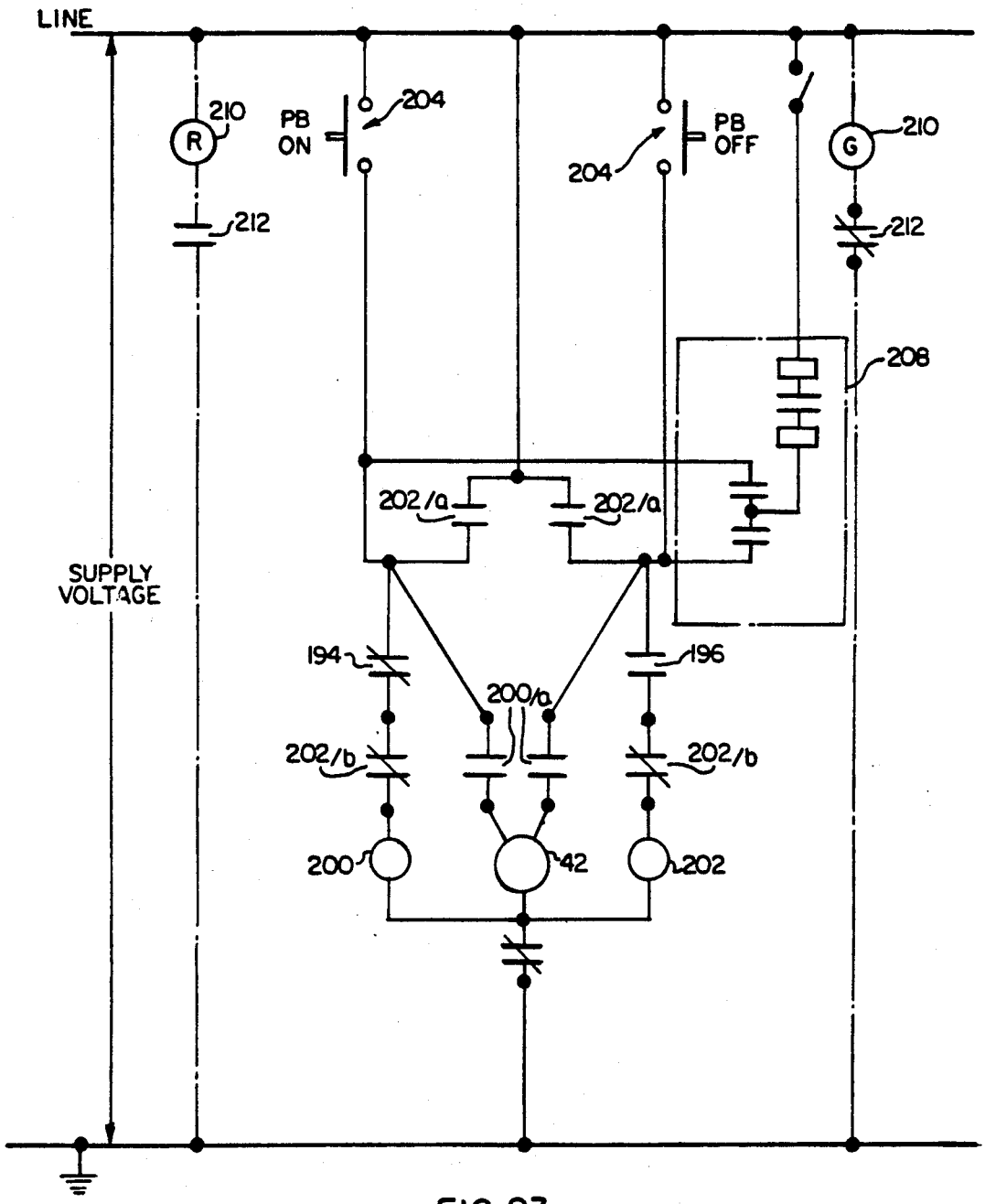
FIG. 23 is a schematic diagram of the electric operator in accordance with the present invention.

Referring to FIGS. 6 and 23, auxiliary relays 200 and 202, rigidly mounted to the housing 30, are used to provide electrical interlocking of the electric motor 42. A pushbutton station 204 may be mounted remotely from the electric operator 20 to allow an operator to control the electric operator 20 from a remote location.

As used herein the designation "200/a" is used to indicate a normally open contact from the auxiliary relay 200. The designation "200/b" is used to indicate a normally closed contact from the auxiliary relay 200. The auxiliary contacts from the auxiliary relay 202 are designated in a similar manner.

As shown in FIG. 23, the electric operator 20 is shown in the open position. In order to close the electric operator 20, the close pushbutton on the pushbutton station 204 is actuated. This action completes an electrical current path from the line side of the power supply through the limit switch contacts 194 and 198 and the normally closed auxiliary contact 202/b to energize the auxiliary relay 200. Once the auxiliary relay 200 is energized, the auxiliary relay 202 is disabled by way of the auxiliary contact 200/b. As long as the electric operator 20 is in the Electrical Operation mode of operation, the electric motor 42 will be enabled by way of an auxiliary contact 200/a. If momentary contacts are utilized in the pushbutton station 204, an additional auxiliary contact 200/a may be connected in parallel across the pushbutton station 204 close contact to seal-in such a momentary contact. Once energized, the electric motor 42 will rotate in a first direction to drive the drive assembly 40 to a closed position. When the drive assembly 40 reaches the closed position, the limit switch contact 194 will open, which, in turn, will de-energize the auxiliary relay 200, which, in turn, will disable the electric motor 42. The electric operator 20 operates in a similar manner in the reverse direction.

The electric operator 20 may also be controlled by a personal computer by way of a communications integrated circuit chip, such as a Westinghouse type INCOM chip. The INCOM interlock is identified with the reference numeral 206. This interlock is coupled to interlocks within the dashed box identified with the reference numeral 208, described in detail in Westinghouse *Installation Instruct for Motor Operator for R-Frame Circuit Breakers and Molded Case Switches*, Aug. 1990, hereby incorporated by reference.

Red and green pilot lights 210 may be provided at a remote location to indicate the status of the electrical operator 20. Either circuit breaker auxiliary contacts 212, limit switch contacts 194, 196 or auxiliary relay contacts 200 and 202 either singly or in combination, may be used for the pilot lights 208.

Obviously, many modifications and variations of the present invention are possible in light of the above teachings. Thus, it is to be understood that, within the scope of the appended claims, the invention may be practiced otherwise than as specifically described hereinabove.

What is claimed and desired to be secured by letters patent of the United States is:

1. An electric operator for a molded case circuit breaker or molded case switch having a pair of separable main contacts, controllable by an extending operating handle comprising:

a housing;

means for capturing said operating hand;

means for driving said capturing means between a first position and a second position to move said operating handle to open and close said separable contacts;

means for receiving a source of electric power;

means coupled to said receiving means for electrically actuating said driving means; and means for mechanically actuating said driving means including a manual crank assembly having a movably mounted crank hand movable between a cranking position wherein said crank handle extends outwardly from said housing and a retract position wherein said crank handle is disposed within said housing.

2. An electric operator as recited in claim 1, further including means for selectively enabling said electrically actuating means and said mechanically actuating means to provide a plurality of modes of operation of said electric operator.

3. An electric operator as recited in claim 2, wherein said plurality is four.

4. An electric operator as recited in claim 2, wherein said plurality of operating modes includes an electric mode of operation in which the electrically actuating means actuates said drive means and a mechanical mode of operation in which the mechanically actuating means actuates said drive means.

5. An electric operator as recited in claim 4, further including first disabling means for disabling said electrically actuating means from actuating said driving means in predetermined modes of operation.

6. An electric operator as recited in claim 2, further including second disabling means for disabling said mechanically actuating means from actuating said driving means in predetermined modes of operation.

7. An electric operator as recited in claim 2, further including first indicating means for indicating the selected mode of operation.

8. An electric operator as recited in claim 2, further including second indicating means for indicating the position of said driving means.

9. An electric operator as recited in claim 1, wherein said driving means includes a ball screw assembly connected to said capturing means.

10. An electric operator as recited in claim 1, wherein said electrically actuating means includes an electric motor connected to said driving means.

11. An electric operator as recited in claim 1, wherein said mechanically actuating means includes a crank arm rigidly mounted to a crankshaft and a crank handle on said crank arm, and means mounting said crankshaft for reciprocal movement in an axial direction along its own axis between a cranking position in which the crank shaft engages said driving means and a react position in which the crank shaft is disengaged from said driving means.

12. An electrical operator as recited in claim 11, further including means for movably mounting said crank handle on said crank arm for movement between a cranking position and a retract position.

13. An electric operator as recited in claim 12, wherein said crank handle is completely disposed within said housing in said retract position.

14. An electric operator as recited in claim 12, wherein said crank handle extends outwardly from said housing in said cranking position.

15. An electric operator for a molded case circuit breaker or a molded case switch having a pair of main contacts, controllable by an extending operating handle comprising:

a housing;

a handle actuator assembly for capturing said operating handle, mounted for reciprocal movement within said housing;

a drive assembly mechanically coupled to said handle actuator assembly for driving said handle actuator assembly between a first position and a second position to move said operating handle to open and close said main contacts;

an electric motor;

means for coupling said electric motor to said drive assembly; and a manual crank assembly which includes a crank arm and a crank hand coupled to said drive assembly in a first position and disengaged from said drive assembly in a second position.

16. An electric operator as recited in claim 15, wherein aid manual crank assembly includes means for disposing said crank handle outwardly from said housing in said first position and means for disposing said crank handle within said housing in said second position.

17. An electric operator as recited in claim 16, wherein said disposing means includes means for interlocking said manual drive assembly, slidably mounted with respect to said housing, said interlocking means comprising means allowing said crank handle to be disposed outwardly from aid housing in a cranking position and second means for allowing said crank handle to be disposed within said housing in other predetermined positions.

18. An electric operator as recited i claim 17, wherein said interlocking means includes a shutter having an aperture through which said crank arm and said crank hand are movable to said cranking position.

19. An electric operator as recited in claim 17, further including biasing means for biasing said manual drive assembly into engagement with said drive assembly when said interlocking mean is in said cranking position.

20. An operator for a molded case circuit breaker or molded case switch having at least one pair of separable main contacts, controllable by an extending operating handle comprising:

a housing in which said circuit breaker or switch is mounted;

a handle actuator assembly for capturing said extending operating handle, mounted for reciprocal movement within said housing to reciprocally operate said extending operating handle to open and close said separable main contacts;

a drive assembly for driving said handle actuator assembly reciprocally; and a manual crank assembly, mounted for movement within said housing, between a first position wherein said manual crank assembly is in engagement with said drive assembly for cranking said drive assembly to drive said handle actuator assembly reciprocally, and a second position wherein said manual crank assembly is not in engagement with said drive assembly.

21. An operator as recited in claim 20, wherein said manual crank assembly extends outwardly from said housing in said first position and is disposed within said housing in said second position.

22. An operator as recited in claim 20, wherein manual crank assembly includes a crankshaft which engages said drive assembly in said first position, a crank arm mounted on said crank shaft and a crank handle connected to said crank arm.

23. An operator as recited in claim 22, wherein said crank arm is rigidly mounted with respect to said crankshaft.

24. An operator as recited in claim 23, further including means for rotatably mounting said crankshaft with respect to said housing.

25. An operator as recited in claim 24, further including means for mounting said crankshaft for axial movement within said housing.

26. An operator as recited in claim 25, further including means for biasing said crankshaft outwardly from said housing toward said first position.

27. An operator as recited in claim 26, further including means for interlocking said crankshaft having a first position in which said manual crank assembly is expendable to said first position in engagement with said drive assembly and with said crank handle outside said housing and an alternate position in which said manual crank assembly is in said second position, not in engagement with said drive assembly and is blocked from extension to said first position by said interlocking means.

28. An operator as recited in claim 27, wherein said interlocking means includes a shutter, slidably mounted relative to said housing.

29. An operator as recited in claim 28, wherein said housing includes an aperture through which said crank arm, crank handle and crankshaft extend in said first position and wherein said shutter covers said aperture in said alternate position.

30. An operator as recited in claim 20, further including:

an electric motor for driving said drive assembly; and means disabling said electric motor when said manual crank assembly is in engagement with said drive assembly.

* * * * *